United States Patent [19]

Benjamin

[11] Patent Number: 4,852,682

[45] Date of Patent: Aug. 1, 1989

[54] UNDERWATER VOICE COMMUNICATOR

[76] Inventor: Charles M. Benjamin, 5050 Ocean Beach Blvd., #105, Cocoa Beach, Fla. 32931

[21] Appl. No.: 100,175

[22] Filed: Sep. 23, 1987

[51] Int. Cl.[4] ..... G10K 11/00

[52] U.S. Cl. ..... 181/21; 181/176; 367/132; 367/150; 381/154; 381/157

[58] Field of Search ..... 181/18, 20–22, 181/126, 127, 235, 175, 176, 198, 204; 128/200.29, 201.19; 381/153–157; 367/132, 150

[56] References Cited

U.S. PATENT DOCUMENTS

| | | | |
|---|---|---|---|
| Re. 32,062 | 1/1986 | Samodovitz | 73/642 |
| 2,033,337 | 3/1936 | Harmer | 181/176 |
| 2,526,177 | 10/1950 | Webb | 181/21 X |
| 2,705,052 | 3/1955 | Workinger | 181/18 |
| 2,819,771 | 1/1958 | Kock | 181/176 |
| 3,348,537 | 10/1967 | Miller et al. | 128/201.19 |
| 3,348,539 | 10/1967 | McDonald | 128/201.19 |
| 3,620,326 | 11/1971 | Hogge | 181/176 |
| 3,866,711 | 2/1975 | Folds | 181/176 |
| 4,197,921 | 4/1980 | Alphonse et al. | 181/176 |
| 4,527,657 | 7/1985 | Payne | 181/18 |
| 4,527,658 | 7/1985 | Payne | 181/235 |
| 4,726,444 | 2/1988 | Iida et al. | 181/176 |
| 4,753,318 | 6/1988 | Mizuno et al. | 181/204 |

*Primary Examiner*—B. R. Fuller

*Attorney, Agent, or Firm*—Shlesinger & Myers

[57] ABSTRACT

An underwater communicator comprising a transmitter for transmitting acoustical energy between mediums having differing impedance. The transmitter includes first and second ends. The first end is exposed to a first medium while the second end is exposed to a second medium. In the preferred embodiment, the transmitter is formed from a material having a substantially identical impedance to the second medium. An acoustical lens is positioned adjacent the first end of the transmitter. The acoustical lens has a substantially planar front face and a substantially concave shaped rear face. The acoustical lens includes a plurality of spaced vertically extending plates. The vertically extending plates form a substantially right angle with the front face of the acoustical lens. A plurality of spaced plates intersect the vertically extending plates and form an acute angle with the front face of the acoustical lens, thereby forming a plurality of inclined passageways. Upon impact of the acoustical waves on the acoustical lens, the acoustical lens focuses and regulates the waves to maximize the concentration of the same upon impact of the transmitter at any given time.

16 Claims, 2 Drawing Sheets

FIG 1
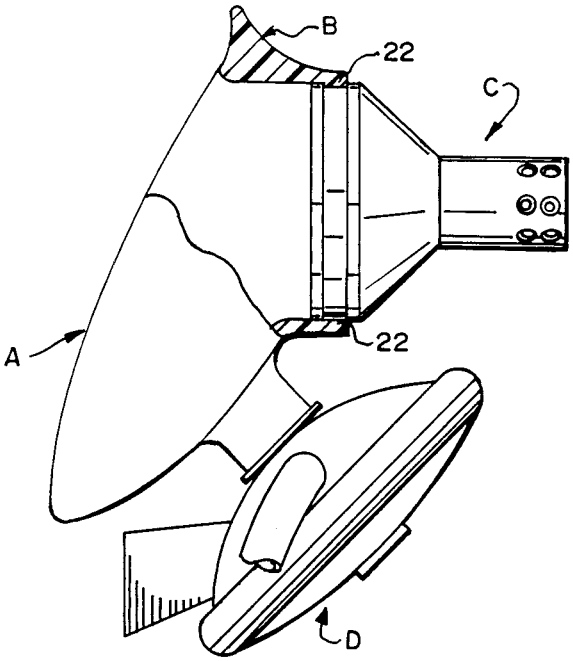
FIG 2
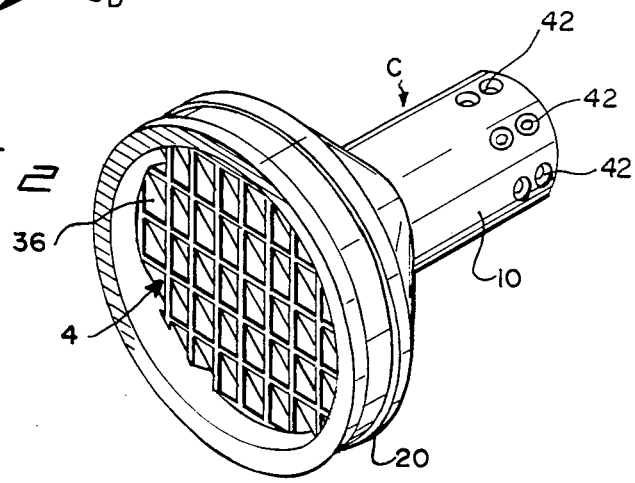
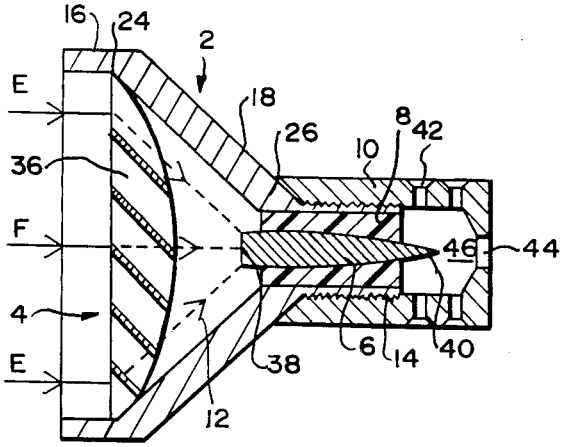
FIG 3
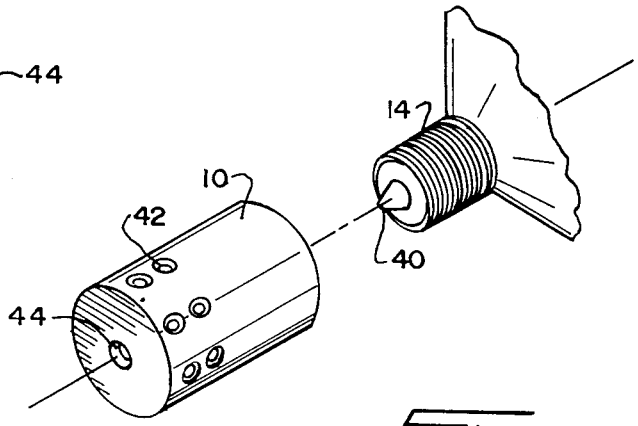
FIG 4

UNDERWATER VOICE COMMUNICATOR

FIELD OF THE INVENTION

This invention pertains to underwater communicators for use with self contained underwater breathing apparatus (scuba) and the like for permitting divers to readily communicate while underwater.

BACKGROUND OF THE INVENTION

It is a well-known principle of wave propagation that when sound waves strike a surface separating mediums having significant differing impedances, a portion of the wave is reflected and hence not transmitted through the second medium. This principle of wave propagation has created significant barriers to divers attempting to communicate underwater. This is due to the fact that the sound waves emitted by the diver must pass from air to water. Of course, an air chamber is formed about a diver's mouth to enable a diver to breathe while underwater. Thus, at the surface defining the boundary between the air chamber and the surrounding water a significant portion of the sound wave is reflected. This phenomenon prevents a diver from projecting his voice to the surrounding water where it can readily be heard by other divers.

Several voice communicators have been developed in an effort to enable divers to communicate while underwater. The following U.S. Pat. Nos. are indicative of the previously known underwater communicators: 3,348,537 Miller; 3,348,539 McDonald; 4,527,657 Payne; and 4,527,658 Payne. The afore-mentioned arrangements for underwater voice communicators have been unable to effectively minimize the reflection of sound waves at the layer separating differing mediums.

OBJECTS AND SUMMARY OF THE INVENTION

It is, therefore, a primary object of the present invention to provide an improved underwater voice communicator.

Another object of the present invention is to provide an underwater voice communicator with an acoustical lens for focusinq acoustical energy at a predetermined area.

Yet another object of the present invention is to provide an acoustical lens which can readily regulate the speed of acoustical energy impacting the lens for maximizing the concentration of acoustical energy impacting a predetermined area at a specific time.

A further object of the present invention is to provide a transmitter for transmitting acoustical energy from a first medium to a second medium wherein the transmitter has an impedance substantially equal to the second medium.

Still a further object of the present invention is to provide a protective housing for the transmitter of the present underwater voice communicator for preventing damage thereto.

Yet another object of the present invention is to provide an underwater voice communicator that can be formed integral with a standard diving regulator.

Yet another object of the present invention is to provide an underwater voice communicator than can be formed from one piece with a mouth piece forming an air chamber about the diver's mouth.

A further object of the present invention is to provide an acoustical lens having a plurality of inclined passageways extending therethrough for regulating the speed of acoustical energy through the lens.

DETAILED DESCRIPTION OF THE DRAWINGS

FIG. 1 is a fragmentary side elevation view of a mask assembly employing the underwater voice communicator formed in accordance with the present invention.

FIG. 2 is a perspective view of the preferred embodiment of an underwater voice communicator formed in accordance with the present invention.

FIG. 3 is a cross-sectional view of the preferred embodiment of the underwater voice communicator of the present invention.

FIG. 4 is a fragmentary exploded view of the preferred embodiment of the underwater voice communicator of the present invention.

DETAILED DESCRIPTION OF THE INVENTION

Figure 5:
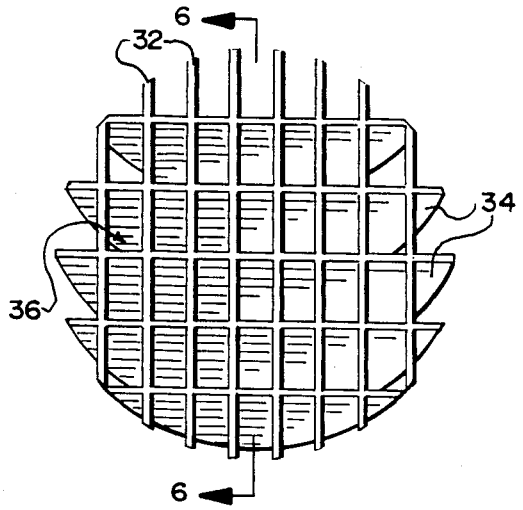
FIG. 5 is a front elevation view of the acoustical lens formed in accordance with the present invention.

Referring to FIG. 1, an underwater mask assembly A includes a mouth piece B defining an air chamber about the diver's mouth, an underwater voice communicator C, and a regulator D.

The underwater communicator C, as best seen in FIG. 3, includes a housing 2, an acoustical lens 4, a transmitter 6, a seal 8, and a sub-housing 10. The housing 2 includes an air passageway 12 and a cylindrical sleeve 14. Housing 2 further includes a cylindrical section 16 and an annular substantially conical shaped section 18. Section 16 has a recess 20, best seen in FIG. 2, formed along its outer periphery for recharging an annular projection 22 extending from mouth piece B. Annular projection 22 forms a substantially watertight seal about the outer periphery of underwater communicator C. Section 18 includes first and second ends 24 and 26 and acoustical lens 4 is positioned in passageway 12 of housing 1 and 2 adjacent end 24 of section 18. Section 18 is tapered in the direction of end 26 to facilitate the channeling acoustical energy emitted by the diver through air passageway 12 to transmitter 6. The cylindrical sleeve 14 is externally threaded for threaded engagement with sub-housing 10.

Although mouth piece B and communicator C are formed, as shown in FIG. 1, from separate pieces, it is within the purview of the present invention to form them from a single piece. Further, the mouth piece B can be eliminated altogether by positioning the communicator C in the regulator D.

Figure 6:
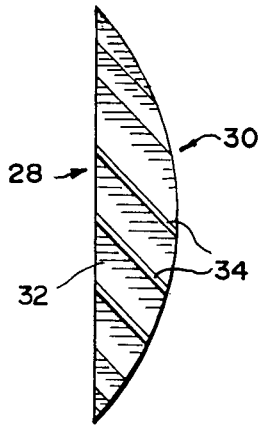
FIG. 6 is a cross-sectional view of the acoustical lens depicted in FIG. 5 taken along lines 6—6.

Referring to FIGS. 5 and 6, acoustical lens 4 includes front face 28, rear face 30, vertically extending plates 32 and angularly extending plates 34. The front face 28 is substantially planar while the rear face 30 is substantially concave in shape. This type of lens is commonly referred to as a converging lens. It will be readily appreciated that the specific configuration of acoustical lens 4 can be varied in order to adjust the focal point of the lens as may be needed. Vertically extending plates 32 are spaced and extend parallel to each other. Similarly, plates 34 are spaced and extend parallel to each other. Plates 34 form an acute angle with the front face 28 of acoustical lens 4. Plates 34 are positioned relative to plates 32 to form a plurality of passageways 36, extending through acoustical lens 4, best seen in FIG. 3. As can be readily seen from FIG. 5, the acoustical lens 4 in the preferred embodiment has a substantially circular cross-section. However, the cross-section of the acoustical lens may be varied to meet the specific conditions of a particular application of the present invention.

The transmitter 6 is positioned within seal 8 located in cylindrical sleeve 14 of housing 2, as best seen in FIG. 3. The transmitter 6 is formed from lead or similar materials having an impedance substantially identical to that of water. The transmitter 6 includes first and second ends 38 and 40. The first end 38 is exposed to air while the second end 40 is exposed to water. The transmitter is tapered from end 38 to end 40 in order to facilitate the propogation of acoustical energy in a forward direction. First end 38 of transmitter 6 is positioned at the focal point of acoustical lens 4.

Referring to FIGS. 3 and 4, the sub-housing 10 includes a plurality of radially extending holes 42 and an axially extending hole 44. The holes 42 and 44 extend through the sub-housing 10 and communicate with chamber 46. Thus, when the voice communicate C is submersed, the chamber 46 readily fills with water. The sub-housing 10 prevents foreign objects from impacting transmitter 6 and thus avoids deformation of the same.

OPERATION

As previously mentioned, when acoustical energy passes between mediums having differing impedances, a significant portion of the acoustical energy will reflect from the surface separating the two mediums. In order to overcome the effects of reflection upon the transmission of sound between differing mediums, the present invention has designed an underwater voice communicator having an acoustical lens that will maximize the concentration of the acoustical energy at the first end 38 of transmitter 6. The acoustical lens 4 achieves this by focusing and regulating the speed of acoustical waves impacting it.

Focusing of the acoustical energy emitted by the diver is achieved by positioning end 38 of transmitter 6 at the focal point of lens 4. By focal point, it is meant that point at which a significant portion of the acoustical energy is directed by lens 4. Before proceeding to discuss the speed regulating feature of acoustical lens 4, one must understand some general principles of the travel of sound waves through acoustical lenses. As can be readily seen from FIG. 3, acoustical waves E impacting the outer portions of the lens 4 have a greater distance to travel than acoustical waves F impacting the lens 4 at its center (the unregulated travel of waves E and F is shown in dotted lines). Thus, without proper regulation, the acoustical wave F will strike first end 38 of transmitter 6 prior to acoustical wave E. Therefore, the concentration of acoustical energy at first end 38 of transmitter 6 will be minimal. As a result, the phenomenon of reflection will be accentuated. The present invention has overcome this disadvantage by providing a plurality of inclined plates 34. As can be readily seen from FIG. 3, the inclined plates 34 will direct the acoustical wave E toward first end 38 of transmitter 6. Further, the plates 34 will initially reflect the acoustical waves F away from the first end 38 of transmitter 6 and subsequently an adjacent plate 34 will reflect wave F toward end 38, thereby increasing the distance that acoustical wave F must travel. As a result, acoustical waves E and F will impact first end 38 at substantially the same time. Therefore, the acoustical energy impacting the transmitter 6 will be maximized thus reducing the effects of reflection.

It should be noted that the plates 34 formed in the lower end of acoustical lens 4 will direct acoustical waves E away from transmitter 6. In order to further maximize the concentration at transmitter 6 the plates 34 formed in the lower portion may be positioned such that they extend upwardly towards the transmitter 6. However, the acoustical lens 4 is effective for permitting underwater communication between divers in the same area while minimizing the costs of manufacture.

The transmitter 6 is formed from lead or other suitable material which has substantially the same impedance as water. Therefore, the acoustical energy transmitted by the transmitter 6 to the surrounding water in chamber 46 will experience little, if any, reflection or refraction.

In an alternative embodiment, the acoustical lens 4 can be formed from a solid having a density which varies along the cross-section of the lens. The density along the cross-section of the acoustical lens should vary proportional to the distance that any acoustical wave impacting the lens at a specified point must travel to the transmitter. By varying the density of the material, one can regulate the speed of the sound waves impacting the transmitter 6 in a similar manner to acoustical lens 4.

While this invention has been described as having a preferred design, it is understood that it is capable of further modification, uses and/or adaptions of the invention following in general the principle of the invention and including such departures from the present disclosure as come within the known or customary practice in the art to which the invention pertains, such as may be applied to the essential features set forth, and fall within the scope of the invention and of the limits of the appended claims.

What I claim is:

1. An apparatus for transmitting acoustical energy between differing mediums, comprising:

(a) means for transmitting acoustical energy from a first medium to a second medium, said first medium having an impedance differing from said second medium;

(b) said transmitting means having an impedance substantially equal to an impedance of said second medium;

(c) said transmitting means including first and second portions, said first portion being exposed to said first medium and said second portion being exposed to said second medium;

(d) means for channeling sound waves from a source to said transmitting means;

(e) said channeling means including a housing provided with a passageway having first and second ends; said first end being operably associated with the source of the acoustical energy and said second end being operably associated with said transmitting means;

(f) means for concentrating acoustical energy at said first portion of said transmitting means positioned in said passageway; and (g) said concentrating means being spaced relative to said second medium.

2. An apparatus as in claim 1, wherein:

(a) said first medium is air; and (b) said second medium is water.

3. An apparatus as in claim 1, wherein:

(a) said concentrating means includes a converging lens.

4. An apparatus as in claim 3, wherein:

(a) said converging lens includes a plurality of first and second plates;

(b) said first plates are spaced and extend substantially parallel to each other; and (c) said second plates are spaced and extend substantially parallel to each other.

5. An apparatus as in claim 4, wherein:

(a) said second plates intersect said first plates forming a plurality of passageways extending through said concentrating means.

6. An apparatus as in claim 5, wherein:

(a) said converging lens includes first and second surfaces;

(b) said first surface being positioned adjacent the source of the acoustical energy and said second surface being positioned adjacent said transmitting means; and (c) said first plates extend perpendicular to said first surface; and (d) said second plates extend at an angle to said first surface other than 90° whereby said second plates regulate the speed of the acoustical energy impacting said converging lens means such that the acoustical energy impacting at least a portion of the outer periphery of said converging lens and the acoustical energy impacting the center of said converging lens reach said transmitting means at substantially the same time.

7. An apparatus as in claim 6, wherein:

(a) said converging lens includes top and bottom edges; and (b) said second plates form an angle with said first surface of said converging lens such that said second plates extend downwardly from said top edge of said converging lens.

8. An apparatus as in claim 6, wherein:

(a) said first surface of said converging lens is substantially planar; and (b) said second surface of said converging lens is substantially concave in shape; and (c) said converging lens is substantially circular in cross-section.

9. An apparatus as in claim 1, wherein:

(a) said transmitting means includes a transmitter substantially conical in shape.

10. An apparatus as in claim 9, wherein:

(a) said transmitter is formed from lead.

11. An apparatus as in claim 10, wherein:

(a) said transmitting means further includes a sub-housing operably associated with said housing means for preventing damage to said transmitter.

12. An apparatus for permitting a diver to communicate readily under water, comprising:

(a) means for forming an air chamber about a diver's mouth;

(b) means for transmitting acoustical energy produced by the diver from said air chamber to the surrounding water;

(c) said transmitting means including a transmitter having substantially the same impedance as water;

(d) said transmitter including first and second portions, said first portion being operably associated with said air chamber and said second portion being exposed to the surrounding water;

(e) means for channeling sound waves emitted by the diver to said transmitter;

(f) said channeling means including a passageway having first and second ends, said first end being operably associated with said air chamber and said second end being operably associated with said first portion of said transmitter;

(g) said channeling means further including means for concentrating the acoustical energy at said first portion of said transmitter; and (h) said concentrating means being spaced relative to the surrounding water.

13. An apparatus as in claim 12, wherein:

(a) said means for forming said air chamber includes a mouthpiece; and (b) said passageway of said channeling means and said mouthpiece are formed from a single piece.

14. An apparatus as in claim 13, wherein:

(a) said mouthpiece is a regulator.

15. An apparatus as in claim 12, wherein:

(a) said concentrating means includes a converging lens having a plurality of first and second plates;

(b) said first plates are spaced and extend parallel to each other;

(c) said second plates are spaced and extend parallel to each other; and (d) said second plates intersect said first plates forming a plurality of passageways.

16. An apparatus as in claim 15, wherein:

(a) said converging lens means includes first and second surfaces;

(b) said first surface being substantially planar; and (c) said second surface being substantially concave in shape.

* * * * *